United States Patent [19]

Simon

[11] 4,343,458

[45] Aug. 10, 1982

[54] SUPPORTS OF BOOM END SHEAVES OR SIMILAR FOR A LIFTING AND/OR HANDLING MACHINE

[76] Inventor: François Simon, Rte. d'Annecy, 73410 Albens, France

[21] Appl. No.: 150,636

[22] Filed: May 16, 1980

[30] Foreign Application Priority Data

May 18, 1979 [FR] France ..... 79 12687

[51] Int. Cl.[3] ..... B66D 3/08

[52] U.S. Cl. ..... 254/399; 254/415

[58] Field of Search ..... 254/399, 398, 413, 416, 254/337, 326, 415, 394

[56] References Cited

U.S. PATENT DOCUMENTS

| | | | |
|---|---|---|---|
| 1,149,837 | 8/1915 | King et al. | 254/399 |
| 2,650,066 | 8/1953 | Troyer | 254/415 |
| 2,708,565 | 5/1955 | Woolslayer et al. | 254/399 |
| 2,973,942 | 3/1961 | Schaper | 254/399 |
| 3,006,608 | 10/1961 | Amino | 254/415 |
| 4,084,794 | 4/1978 | Wallace | 254/399 |
| 4,098,492 | 7/1978 | Wilkinson | 254/399 |

*Primary Examiner*—Billy S. Taylor

*Attorney, Agent, or Firm*—Berger & Palmer

[57] ABSTRACT

A support for boom end sheaves for lifting and/or handling machines, carrying at least a first sheave which receives a flexible rope, particularly a lifting cable, extending from the boom, is characterized in that it carries a pulley-block mounted on a lever which is swingingly carried by the support.

6 Claims, 6 Drawing Figures

41
62
4
13
40
45
44
3
40
64
48
43
42
42'
37
81
38
50
39
49
49
51
52
71
51
13
20
55
54
56
72
59

SUPPORTS OF BOOM END SHEAVES OR SIMILAR FOR A LIFTING AND/OR HANDLING MACHINE

The invention relates to sheave support provided on boom ends, or similar, of lifting and/or handling machines.

Its object is to improve machines of said type which are used particularly for towing operations where the load is not always located at the vertical of the boom.

According to the present invention, the support of boom end sheaves or similar devices for lifting and/or handling machines, carrying at least one first sheave receiving a flexible rope, particularly a lifting cable, from the boom, is characterized in that it carries a pulley-block mounted on a lever swingingly supported by the support.

Preferably, first means are provided for locking the lever relative to the support in at least one position. Preferably, said position is that for which the lever is in an upper position, for example, in the alignment of the boom, particularly for the transportation of the machine, or horizontal when working under a ceiling where the vertical space required has to be limited to its minimum.

The locking means are, for example, provided by a transverse spindle introduced and locked inside holes of support flanges and the lever, said holes being previously aligned. The spindle may be operated directly by hand or through a remote control.

According to a further improvement, a lifting pulley-block is hung onto the pulley-block provided at the end of the pulley-block carried by the lever, and second means are provided for locking the lifting pulley-block relative to the lever in the upper position of the pulley-block.

Said second means are, for instance, provided by at least one lug, articulated at one end on the lever or on the body of the pulley-block and adapted for being attached, at its other end, to the body of the lifting pulley-block or to the lever.

The two hereabove locking operations may be carried out independently from each other, or simultaneously, depending on needs. For example, for the transportation of the machine, the lever and the lifting pulley-block can be locked in alignment with the boom.

According to a further characteristic, the various sheaves of the boom end, of the pulley-block carried by the lever and of the lifting pulley-block are hollow so as to receive axially lifting accessories such as a lifting beam or a rope-sling guide, or any other equipment such as an end of travel mechanism or a function control device.

The invention will become more apparent from the following description and in conjunction with the accompanying drawings.

Figure 1:
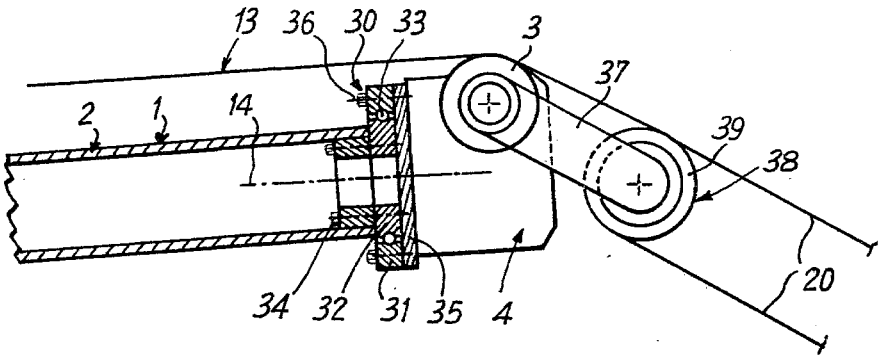
FIG. 1 is a side view, partly in cross-section, of the support of the invention.

In FIG. 1 is shown the end 1 of a boom 2, for example telescopic, of a lifting machine. The boom 2 carries at its end at least a boom end sheave or pulley 3 loosely mounted on a support 4.

According to an advantageous feature, the support 4 is free to rotate over 360° about a geometrical axis 14 which, preferably but not necessarily, is parallel to the boom 2 axis, or better still, coincident therewith.

There is provided a device 30, a so-called orientation crown, comprising two coaxial elements 31, 32 rotatably mounted one on the other via a bearing 33. The outer element 31 is annular and, preferably, the inner element 32 is also annular.

In the embodiment which has been adopted, the inner element is operatively connected to the end 1 of the boom 2, for instance by bolts as at 34. Similary, the outer element 31 is operatively connected to a flange 35 of the support 4, for instance by bolts as at 36.

The axis of the orientation crown forms the axis of rotation 14 for the support 4 relative to the boom.

The support 4 which carries the sheave 3 and is adapted for rotating about the axis 14 in any suitable manner, for example by the crown 30, carries in turn at least one lever 37 articulated on the support 4. The articulation axis of the lever 37 on support 4 is preferably perpendicular to axis 14, and preferably still, coincident with the axis of sheave 3.

The lever 37 carries, at its free end remote from the support 4, a pulley-block 38 with several sheaves or pulleys 39. With such an arrangement, when the set of cable runs 13 performs a towing operation, the lever 37 comes of its own in alignment with the towing direction, thereby providing very good working mechanical conditions.

Figure 2:
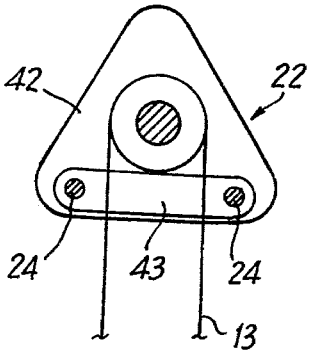
FIG. 2 is a cross-sectional view showing the coaxial sheaves and the cable guide.
Figure 3:
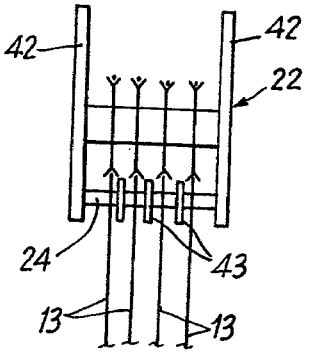
FIG. 3 is a frontal view of the assembly of FIG. 2.

FIGS. 2 and 3 represent a further advantageous characteristic of the present invention. This improvement applies to a cable guide 22. Said cable guide 22 cooperates with the pulley-block 38, the runs of which eventually assume a variable position. The cable guide 22 comprises two outer flanges 42 connected to the support 37 of the pulley-block sheaves through cross-bars 24; between the planes of two successive sheaves, the cross-bars 24 carry plain lugs 43, parallel to the sheave planes; said lugs may be simple bars but also flanges extending so as to face the sheaves. Their function is to separate the pairs of cable runs 13 extending from the various sheaves of the pulley-block. Said cable guide 22 prevents the cable from coming out from the sheave grooves. Friction and an eventual tangling of the cable are thereby avoided.

A description will now be given of the embodiment of FIGS. 4 to 6, wherein the same reference numerals are used to designate elements similar to those of FIGS. 1 to 3.

The support 4 comprises two end vertical flanges 40 connected to each other at their upper edges via a soldered plate 41.

The sheave 3, which is single in the example under consideration, is of the hollow type. It comprises (FIG. 5) an inner annular member 42 fixed to one of the flanges 40 by a suitable means 42', a bearing 43 and an outer annular member 44 mounted loose in rotation on bearing 43 and formed with a groove 45 for the lifting cable 13.

Preferably, the support 4 is here again free to rotate over 360° about a geometrical axis 14 which, preferably but not necessarily, is parallel with the boom 2 axis, or better still, coincident therewith.

For reaching this result, one may use the means 30 of FIG. 1, of the orientation crown type. As shown in FIGS. 4 and 6, one may also secure to the support 4 a tube 46 axially and rotatably mounted inside the boom 2 via bearings 47. The axis 14 is slightly remote from the section of cable 13 which is inside the boom 2 and extends up to the lifting winch (not shown).

Between the flanges 40 of support 4 is mounted a tube 48, coaxial with the sheave 3, on which is mounted, loose in rotation, the oscillating lever 37. Said lever comprises two end flanges 49, parallel to flanges 40, located therebetween and in their vicinity. The lever 37 is suitably stiffened by a strut 50.

At its end which is opposite the tube 48, the lever 37 carries a pulley-block 38 the sheaves or pulleys 39 of which are mounted on the flanges 49 in a similar way as is mounted the sheave 3 on the flanges 40. Mounting bolts 51 extend through the flanges 49 and the fixed ring portions of the sheaves 39. A tube 52, coaxial with the sheaves 39, extends through the pulley-block 38 and flanges 49 assembly, and is secured against motion by suitable means. The plane of sheave 3 is in alignment with the plane of and end sheave 39.

To the lever 37 is hung through the lifting cable 13 a lifting pulley-block 54 comprising three loose sheaves or pulleys 55 the inner ring members of which are fixed to the two end flanges 56 by bolts 57.

A tube 58, similar to tubes 48 and 52, extends axially through the sheaves 55 and is attached to the flanges 56.

A hook 59 is articulated at the lower portion of the pulley-block 54.

Figure 4:
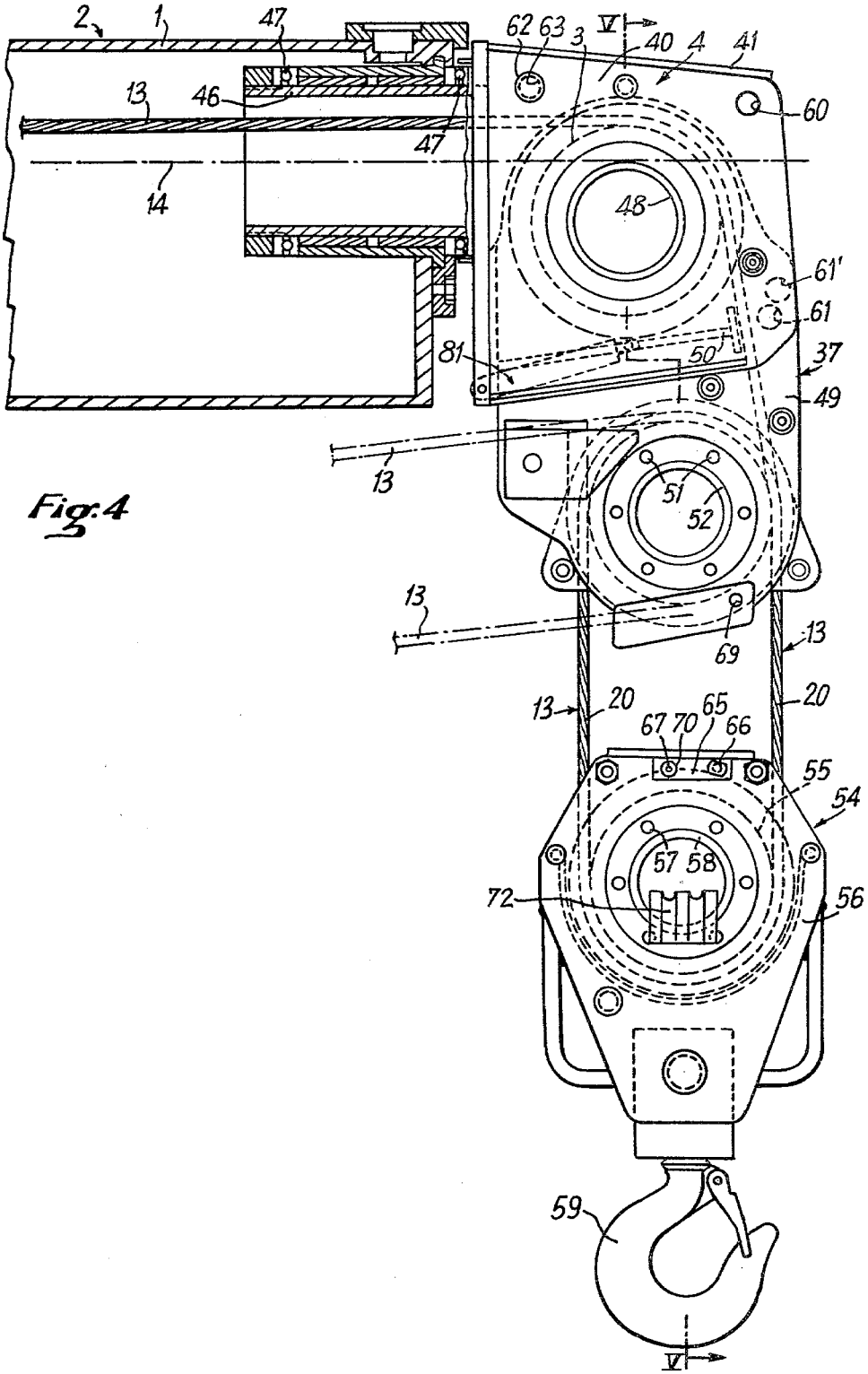
FIG. 4 is a side elevation view, partly in cross-section, of an alternative support for boom end sheaves.
Figure 5:
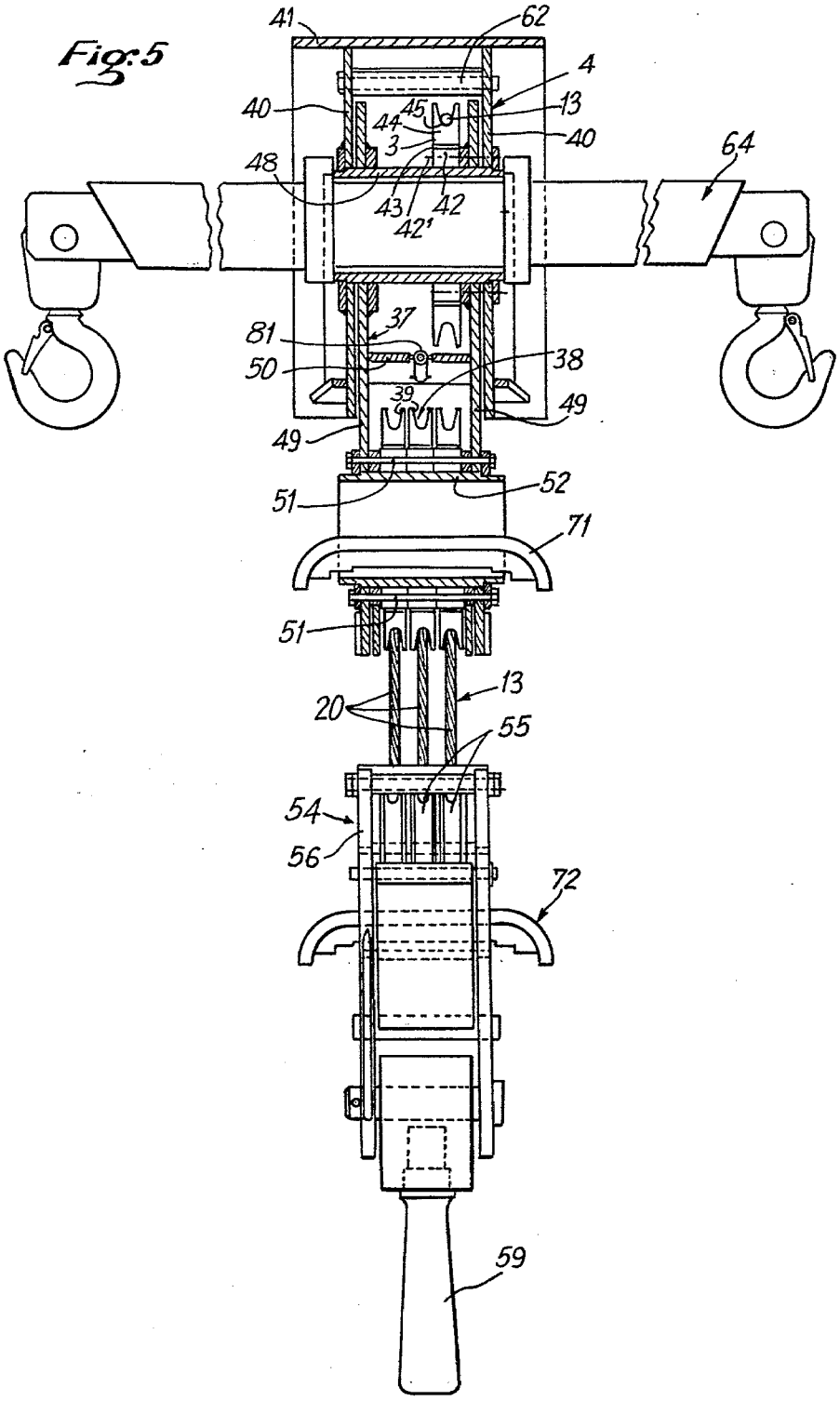
FIG. 5 is a vertical cross-sectional view along line V—V of the support of FIG. 4, lifting accessories being added thereto.

The assembly thus described can operate in the position shown in FIG. 4, as that of FIG. 1, for normal lifting operations, the position in which the lever 37 is in a lower position, due to gravity, and the lifting pulley-block 54 is located under the pulley-block 38. The cable 13 extending from the boom runs first on the boom end sheave 3, then alternately on the sheaves 39, 55 of the pulley-blocks 38 and 54, its end being secured to one of the pulley-blocks.

Owing to the possible rotation of the support 4 about axis 14, the assembly can also operate sideways, for a transverse towing operation.

As is shown in chain-dot lines in FIG. 4 for the cable 13, the assembly can also operate so that the cable runs between pulley-blocks 38 and 54 are substantially parallel to the boom 2 while running under it, the lever 37 coming then in abutment against support 4.

If the load is pulled, for towing works which can be combined with a sideways operation, the pulley-blocks 38 and 54 come on their own in alignment with the tube 48 axis, due to the floating mounting of the lever 37, thereby allowing the machine to operate under good mechanical conditions.

Means are provided for temporarily connecting the lever 37 and the support 4, at least in one position.

Said position is for instance that in which the lever 37 is in alignment with the boom 2 (FIG. 6) or that in which the boom is horizontal.

For providing this locking operation, one forms in the flanges 40 and 49 of support 4 and lever 37, well outside of the sheaves contour, holes 60, 61 of same diameter which, when the lever 37 is brought to a locking position, are in alignment for receiving a spindle 62. When not used for locking the assembly, the spindle 62 is kept in stand-by holes 63 of flanges 40, in an area where it cannot interfere with the operation. As is shown at 61', there are several pairs of holes 61 allowing the locking to be effected in several positions.

The possibility of operating with the lever 37 in a raised or upper position offers the advantage, without modifying the machine, of gaining space in height, thereby allowing working under a ceiling.

In such a case, the lever 37 is preferably in a horizontal position and the towing is carried out either by tipping the boom, or with the cable 13.

One can also lock the lever 37 when the machine is moved, without being used, or when one uses a lifting beam or a rope-sling guide received in the tube 48, the lifting being then carried out by simple movement of the boom. As an example of this use, there is shown in FIG. 5 a lifting beam 64 received in the tube 48.

The tipping of lever 37, in order to be brought in its locking position, could be controlled by a jack 81 (shown in chain-dot lines) acting between the strut 50 and the support 4.

Extra means are provided for temporarily operatively connecting the lever 37 and the pulley-block 54 when the latter is brought in abutment against the lever 37.

The flanges 56 of the pulley-block 54 carry outside, on either side, a lug 65 articulated at 66 on the associated flange 56. At its end which is remote from the articulation 66, the lug 65 is formed with a stand-by hole 67 which, when the small plate is tipped by hand, can come in alignment with holes 68 or 69 formed in the flanges 56 of the pulley-block 54 and in the flanges 49 of lever 37.

In the unlocked position (FIG. 4), the lugs 65 are maintained by a spindle 70 extending through the four holes 67, 68, while, for the locked position (FIG. 6), the lugs 65 operatively connect the lever 37 and the pulley-block 54, in abutment against each other, by having the spindle 70 extending through the four holes 67, 69.

Figure 6:
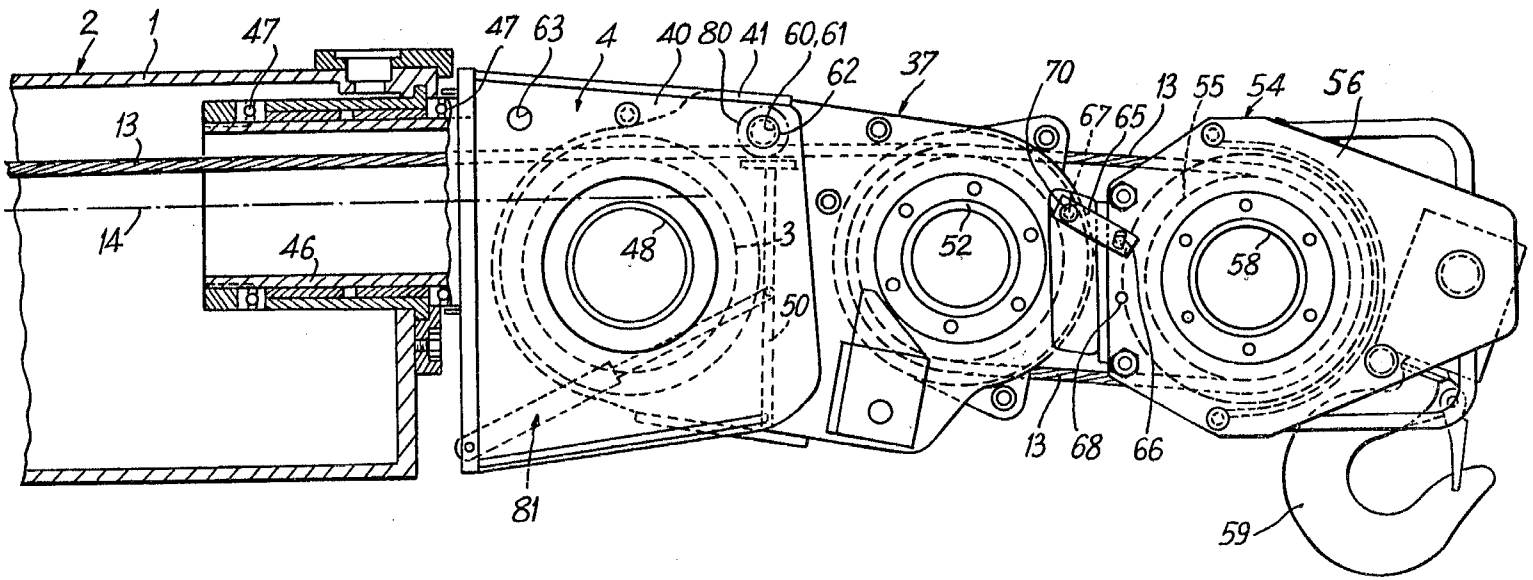
FIG. 6 is a view similar to FIG. 4 for the locked and raised position of the lever and the lifting pulley-block.

The position shown in FIG. 6 is that for which the lever 37 is locked on the support 4 and the pulley-block 54 is locked on the lever 37. This position, reached by a maximum traction applied by the cable 13 and followed by the locking operations, and eventually accompanied by the control from jack 81, is used for the transportation of the machine, in the case where the work has to be performed under a ceiling or in the case where one wishes to use a lifting beam or a rope-sling guide carried by one of the tubes 48, 52, 58.

By way of example, there is shown in FIG. 6 a rope-sling guide 71 carried by the tube 52 and a rope-sling guide 72 carried by the tube 58.

Of course, the user will choose, according to his needs, to carry out one and/or the other of the two locking operations and to eventually use one or the other of the lifting accessories or other equipments carried by the tubes 48, 52 and 58.

One of the advantages of the boom end sheave support according to the invention is that it allows, without increasing the space needed, which is an important factor, using the same machine without any modification, for various lifting, towing and/or handling works requiring normally different machines or at least an adaptation of the machine on the working site and consisting in disassembling or mounting accessories.

I claim:

1. A support for boom end sheaves for lifting and/or handling machines comprising a boom having a free end, a support member attached to said free end, a first sheave attached to said support member, said first sheave having an axis transverse to the longitudinal direction of said boom, a first pulley block comprising pulleys having an axis parallel to that of said first sheave, a lever articularly connected at one end to said first sheave and carrying said first pulley block at its other end, a lifting cable running along said boom, passing on said first sheave and then to said first pulley-block, said pulley axis of said first pulley block being fixed with respect to said lever.

2. A support according to claim 1, wherein the axis of articulation of said lever on said support member is coincident with the axis of said first sheave.

3. A support according to claims 1 or 2, wherein said support member is rotatably connected to said boom about an axis parallel to the longitudinal direction of the boom.

4. A support according to claim 1, comprising first means for locking said lever to said support member in at least one position.

5. A support according to claim 4, wherein said one position comprises that for which said lever is raised substantially to be in alignment with the boom longitudinal direction.

6. A support according to claims 1 or 4, wherein a second lifting pulley-block is hung to said first pulley-block by means of said lifting cable, second means being provided for locking said second lifting pulley-block to said lever.

* * * * *